United States Patent [19]

Heise

[11] 3,952,462

[45] Apr. 27, 1976

[54] PANEL WALL SYSTEMS

[75] Inventor: Jack Darcy Heise, Mount Maunganui, New Zealand

[73] Assignee: Barry Albert Beazley, Mount Maunganui, New Zealand

[22] Filed: May 20, 1974

[21] Appl. No.: 471,711

Related U.S. Application Data

[63] Continuation of Ser. No. 236,121, March 20, 1972, abandoned.

[30] Foreign Application Priority Data

Mar. 18, 1971 New Zealand ..... 163125

[52] U.S. Cl. ..... 52/62; 52/242; 52/293; 52/300; 52/481; 52/669; 52/696

[51] Int. Cl.[2] ..... E04B 2/72; E04B 2/74

[58] Field of Search ..... 52/241, 300, 239, 293, 52/298, 299, 475, 482, 735, 664, 666, 669, 58, 62, 242, 481, 696

[56] References Cited

UNITED STATES PATENTS

| | | | |
|---|---|---|---|
| 1,004,859 | 10/1911 | Dowd | 52/289 |
| 1,194,320 | 8/1916 | Pucillo | 52/669 |
| 2,766,855 | 10/1956 | Johnson | 52/300 |
| 3,101,817 | 8/1963 | Radek | 52/241 |
| 3,204,382 | 9/1965 | McGurn | 52/241 |
| 3,339,327 | 9/1967 | Kempf | 52/347 |
| 3,536,345 | 10/1970 | Leifer | 52/735 |
| 3,633,327 | 1/1972 | Klingensmith | 52/300 |
| 3,785,110 | 1/1974 | Calloway | 52/665 |
| 3,831,333 | 8/1974 | Nelsson | 52/241 |

*Primary Examiner*—Alfred C. Perham
*Attorney, Agent, or Firm*—Holman & Stern

[57] ABSTRACT

A panel wall system in which there is provided a base plate in the form of a channel having a number of slots at predetermined positions in the walls of the panel and panels which have extensions adapted to fit into the channel defining the base plate. The extensions have ears thereon which engage the slots so that the spacing from one panel to the next and also the position of the panel relative to the base plate is fixed. The panel system is provided with flashing affixed to the base plate and a suitable skirting member is disclosed.

4 Claims, 11 Drawing Figures

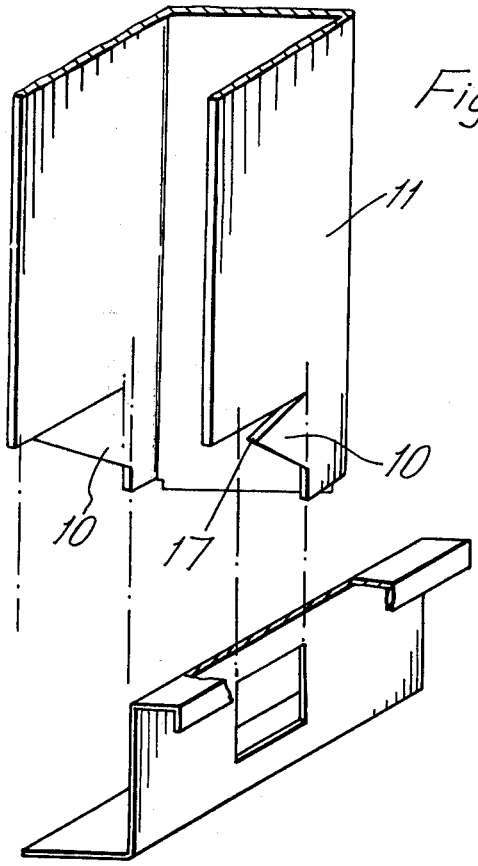
Fig. 6.
Fig. 7.
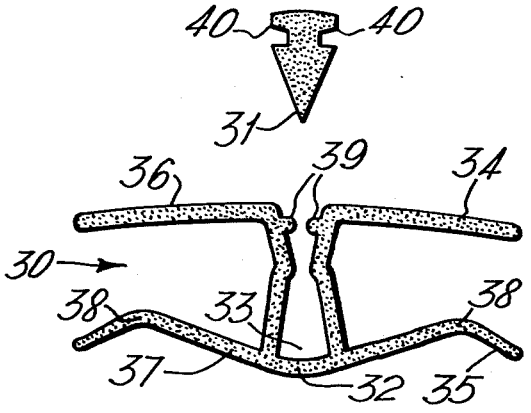

84
83
81
80
82
101
70
100

PANEL WALL SYSTEMS

This is a continuation of application Ser. No. 236,121, filed Mar. 20, 1972, now abandoned.

This invention relates to panel wall systems.

For many purposes, it is desirable that a building may be constructed using panels as the walls thereof, with the panels being prefabricated and erected on the site.

PRIOR ART

At present, the panels in use have disadvantages in that the panels and the joining systems used are such that a skilled worker must still work on the site to obtain satisfactory spacing of panels due to imperfections in the panels and in the jointing systems. Thus, if the panels are placed too close to each other and the jointing systems are disposed to reduce the distance between the panels obviously a wall of panels will be short of a desired length. Conversely, if the panels are spaced too widely apart and the jointing strips accentuate this width, then the panels will be too wide and the wall will be too long for its particular disposition.

Furthermore, in panel wall constructions, there is some difficulty in providing adequate flashing where the wall comprises an outer wall, and also where the panel frame is metal, there is some difficulty in fixing skirting quickly and readily on interior wall surfaces.

OBJECTS AND SUMMARY OF THE INVENTION

It is, therefore, an object of the present invention to provide a panel wall system which will obviate or minimize the foregoing disadvantages in a simple yet effective manner or which will at least provide the public with a useful choice.

Accordingly, in one aspect, the invention consists in a method of preparing a panel wall system for erection, said method including the steps of preparing a base frame for a wall, providing panel engaging means at intervals along the length of the base plate, and providing base plate engaging means on said panel so that when the coacting engaging means are installed by means of temporary distortion against resistance thereof of a selected one of said base plate, said panel and said base plate and said panel, each panel is fixed relative to the base plate so that the spacing between panels is automatically fixed and the position of each panel on erection is also automatically fixed.

In a further aspect, the invention consists in a panel wall system including a base plate, said base plate having at suitable intervals thereon, panel engaging means and a plurality of panels, each panel also having coacting base engaging means, with the construction and arrangement being such that on erection by temporary deformation against resistance thereof of a selected one of said base plate, said panel and said base plate and said panel, each panel is fixed relative to said base plate so that the spacing from one panel to the next panel is fixed by the spacing of said panel engaging means.

In a still further aspect, the invention consists in a panel for use in a panel wall system as described in the preceding two paragraphs wherein said panel includes as a lower member, thereof an inverted Pi (PP) or U shaped member the legs of which are formed by two members defining a slot therebetween, each slot having an open mouth extending to or near the cross bar of the Pi member or base of the U, with the construction and arrangement being such that in use, a skirting having a suitable web positioned thereon or a flashing member also having a suitable web thereon may be positioned with the web contained within the one of said slots for the purpose of retaining the skirting or flashing in position.

The invention consists in the foregoing, and also envisages constructions of which the following gives examples only, and where specific integers are mentioned herein which have known equivalents in the art to which this invention relates, such known equivalents are deemed to be incoporated herein as if individually set forth.

One preferred form of the invention and modifications thereof will now be described, with reference to the accompanying drawings in which:

BRIEF DESCRIPTION OF THE DRAWINGS

FIG. 6 is an alternative embodiment of FIGS. 2 and 5, FIG. 7 is a plan view of a jointing member according to the invention.

DETAILED DESCRIPTION OF THE EMBODIMENTS

Figure 1:
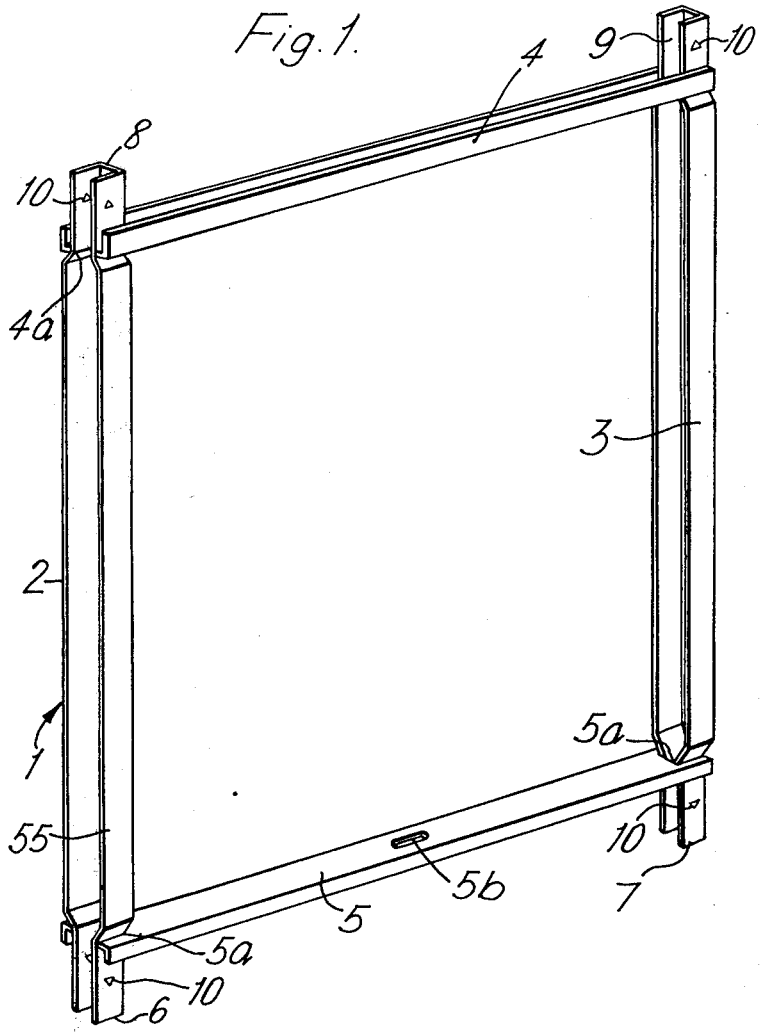
FIG. 1 is a perspective view of a panel frame according to the invention.
Figure 2:
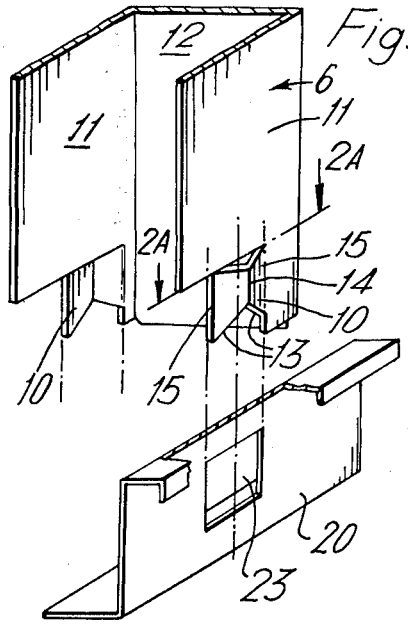
FIG. 2 is a perspective view of a panel engaging means and a base engaging means according to the invention.
Figure 3:
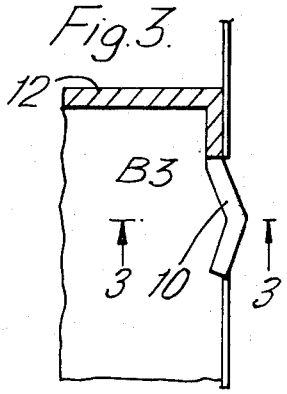
FIG. 3 is a cross-section on 2A—2A in FIG. 2.
Figure 4:
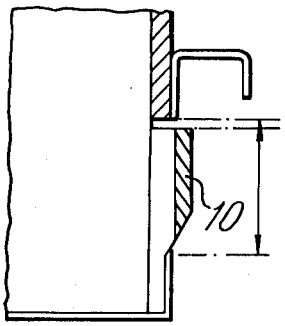
FIG. 4 is a cross-section on 3—3 in FIG. 4.

In the preferred form of the invention, wall panels are made as follows.

A frame 1 is constructed preferably from metal although any other suitable materials may be used. The frame elements may be made by, for example, folding sheet metal to a channel shape or by extruding metal to a suitable shape and the members are assembled using pop rivets, spot welding, by self-tapping screws or in any other convenient way. The frame 1 has at least two uprights 2 and 3 and preferably a center upright (not shown) or stud with a channel member 4 at the top and a further channel member 5 at the bottom. The uprights 2 and 3 pass through cut outs at 4*a* and 5*a* and the center upright (not shown) passes through apertures 5*b* in members 5 and 4 with only the aperture 5for the member 5 being shown. A preferred form of bottom member 5 will be described later. The uprights 2 and 3 are arranged so that at least their lower ends 6 and 7 and preferably also their upper ends 8 and 9 extend a short distance below the bottom member 5 and above the top member 4 respectively. The upright members 2 and 3 may be swaged inwardly at the ends thereof and the top and bottom members 4 and 5 engaged with the narrower portion of the upright members 2 and 3.

The extended portions 6, 7, 8 and 9 are provided with base engaging means constructed as follows. Adjacent the base of the channel forming each upright 2 and 3, an ear 10 is cracked or lanced out of the parent metal from side 11 of the upright member 2 or 3 so that each ear has a part which extends in a plane substantially parallel to the plane of base 12 of the upright member 2 or 3. The ear 10 may be in the form of a substantially V shaped extension, with the apex of the V being further from the side 11 of the upright member and the other extremities of the arms of the V lying substantially adjacent the side 11. Bottom edges 13 of the ear may be cut so that the apex of V 14 is of a shorter length than the other extremities of arm 15.

Figure 5:
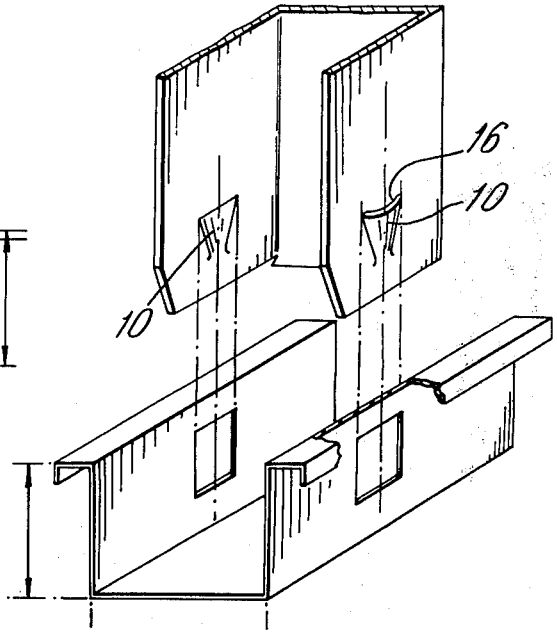
FIG. 5 is an alternative embodiment of FIG. 2.

Alternatively, the ear may be as shown in FIG. 5 with upper edge 16 of ear 10 being in the form of an arc and the ear 10 tapering inwardly and together downwardly. As a further alternative, the ear 10 may be constructed as shown in the FIG. 6, that is, in the form of a pennant having point 17 farthest away from the side 11. Of course, the ear 10 may be constructed in any other suitable manner.

Preferably, the ears 10 are formed in each side 11 of the upright member 2 or 3.

The upper extension 8 and 9 of the upright 2 and 3 may have and preferably do have similar ears 10 provided thereon.

Figure 11:
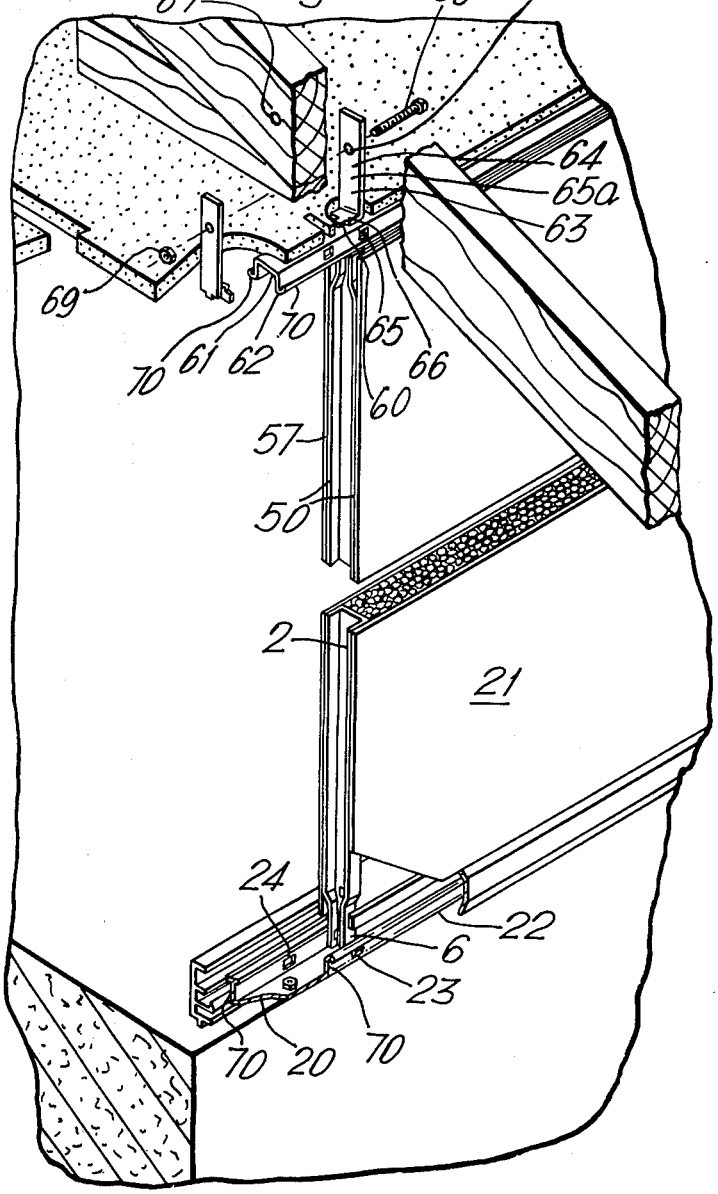
FIG. 11 is a perspective view of a wall panel system according to the invention.

A base plate 20 for a wall 21 (FIG. 11) is provided again comprising preferably a metal channel member, for example, folded out of the galvanized steel or extruded as desired.

In sides 22 of this channel, slots 23 are provided at intervals and these slots 23 are adapted to receive an ear 10 when a panel is in position. Consequently, the slots 23 must be positioned to correspond with the length of a panel with some provision being made to enable slight variations in panel width to be obtained, although the panel frame will be likely to have only small dimensional variations, particularly if made of metal. The provisions may be for example providing a slot is a little larger than the ear 10 which it is to accommodate or by any other suitable method. Thus, in a particular base channel 20, the slots 23 are made to receive one panel, and then at a suitable interval from one of these slots 23, a further slot 24 is provided to receive the adjacent upright of the next panel. The spacing of the slots 23 to support one panel and the slots 24 to support the next panel will depend on the jointing means used. We prefer to use the jointing strips as shown in FIG. 7 which comprise a jointing member 30 and a plug member 31. The jointing member 30 comprises two substantially *h* shaped members joined by stems 32 of each of the substantially *h* shaped members. Thus, a channel 33 is provided between the saddles of the two *h* shaped members which allows the jointing member to be compressed a little if necessary. The adjacent panels are adapted to fit between the arms of the *h* shaped members, and thus one panel fits between arms 34 and 35 and the other panel fits between arms 36 and 37. The arms 35 and 37 may be shaped to have an inward facing knee 38, which is forced outwardly when engaged with the panel so that some pressure is applied to the panel by the jointing member. Longitudinal ridges 39 or alternatively grooves (not shown) are provided on the saddle of the *h* shaped members.

The plug member 31 is, for example, substantially triangular in cross section and includes grooves 40 or ridges (not shown) which grooves 40 or ridges (not shown) are adapted to be engageable with the ridges 39 or grooves (not shown) on the jointing member 30.

Thus, the plug member 31 may be forced into the gap 33 until the coaction of the ridges and groove will allow the plug member to be pushed no further into the jointing member 30.

Alternative jointing means may be provided as desired, for example, the jointing means may comprise simply two substantially *h* shaped members joined by the stems of the two *h* shaped members and having a knee therein in the arm of the *h* opposite to the stem thereof.

Where it is desired to join two panels substantially at right angles to each other, a jointing member may be provided which is substantially in the form of a double V member having a spacer between the apices of the V. A knee may be provided in each arm of the V which is not to be on view so that a pressure may be applied to the panel held between the arm of the two V members.

Where it is desired to abut one panel to a mid point on another panel, a substantially H shaped member may be provided having the upper arms of the H turned inwardly and the lower arms turned outwardly so that the two upper arms may have a panel placed therebetween and the two lower arms of the H may be butted on to the upper wall panel to provide a satisfactory finish.

As a further alternative, a substantially *h* shaped member may be provided having the stem of the *h* turned outwardly through for example, about 62° so that a panel may be fitted between the arms of the *h* shaped member and the saddle moved towards another panel so that the stem of the *h* shaped member is turned further to provide a decorative finish.

A substantially Z shaped clamp may also be provided. One arm of the Z may have a bolt or the like device to fix the clamp to one panel by, for example, bolting to upright 2 or 3 and the other arm of the clamp may have parts extended sideways adapted to engage two panels at right angles to the first panel.

The panels are completed by cladding them with a suitable cladding material 50 and I find that an asbestos cement material such as that sold under the trade name HARDIFLEX is particularly satisfactory for both sides of a panel even for interior uses. However, other cladding materials may be used, for example, plywood, sheetsteel, molded plastics material, or any other suitable material.

To complete the panels, an adhesive is applied on one side 55 (FIG. 1) of the frame 1 and a cladding sheet 50 simply placed on this side of the frame. If the uprights 2 and 3 are swaged, the cladding sheet 50 will be substantially coplanar with the extremities of the base plate 20. A group of these are prepared and when the adhesive is set, the group is then insulated, if desired, by placing sheets of insulating material, for example, prepared sheets of polystyrene or polyurethane in position. The remaining exposed face 56 then has an adhesive applied thereto and the remaining cladding 57 applied and left to set.

Where windows and/or doors are required, these will be fitted in the panel during manufacture and in some cases, a panel will simply comprise a door frame or a window frame.

As alternatives to the abovementioned insulant, it may be desirable to use a foamed urethane which is foamed in situ in the panels. This may obviate the use of an adhesive or an adhesive may be used in addition, between the panel cladding 50 or 57 and the frame 1.

In addition to the base plate, a capping member may be provided as follows.

The capping member is substantially indentical to the base plate except that connection means to enable the capping member to be affixed to a roof may be provided.

The connection means may comprise slots 60 cut in a base 61 of the capping member 62. The slots are preferably in the shape of a rectangler having a greater length than breadth but, in any event, the length would be greater than the breadth. The connection means may further include a link member 63 which may be constructed as follows. The link member may include a strip member 64 which is turned through substantially a right angle at 65 at the lower end thereof. The strip member is then turned through a further right angle at 66 and part in a plane parallel to the part 65*a* adapted to be affixed to a roof joist has slots cut therein which are adapted to engage the sides of the slots 60. The link member is engaged with the slot by passing the link member so that the width of the link member is parallel to the longitudinal axis of the capping member through the slot 60 and rotating the link member through for example 90° so that the edges of the slots 60 pass into the slots in the link member and thus the link member cannot be withdrawn from the slot 60 without further rotation of the link member. An aperture 120 may be provided in the link member and a further aperture 67 in the roof joists so that the link member may be, for example, bolted to the roof joists by a bolt 68 and secured by nut 69.

Both the base plate and the capping member may have the upper edges of each arm turned to form a substantially J shaped member or U shaped member 70 to which may be affixed flashing or skirting or an architrave as desired.

Figure 8:
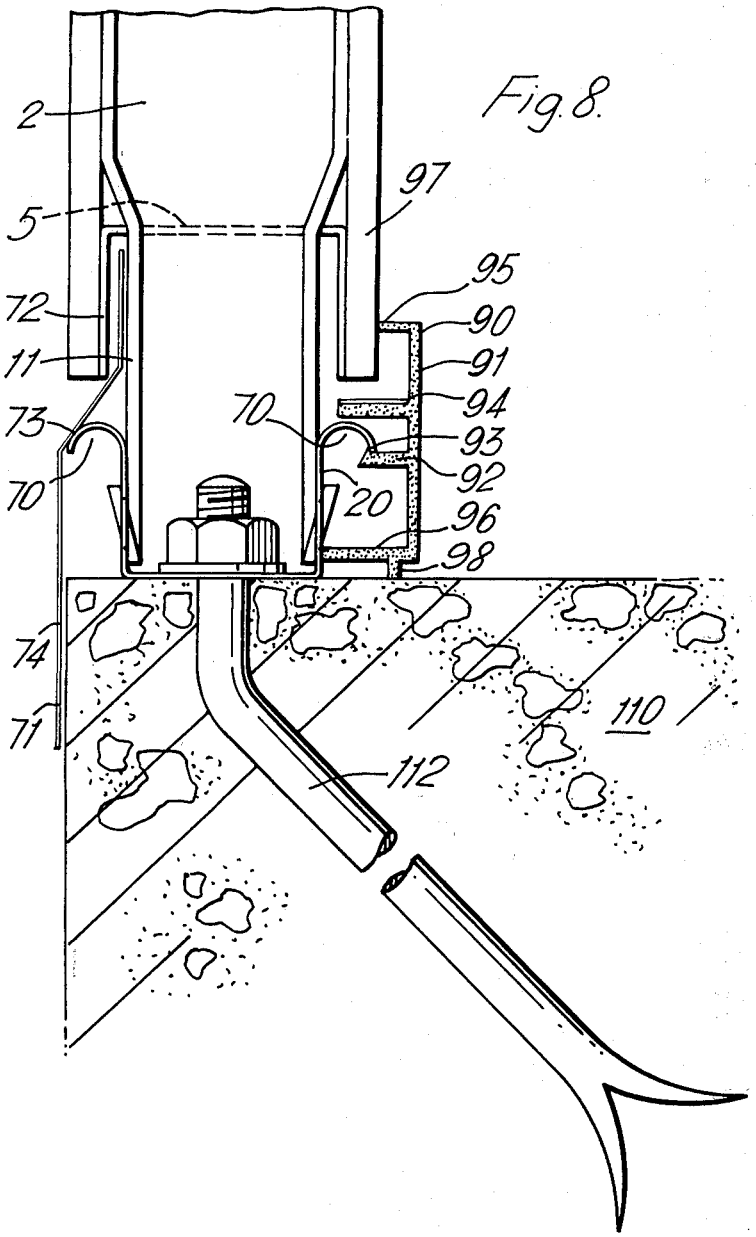
FIG. 8 is a cross-sectional view of the lower part of a wall panel fixed to a floor according to one embodiment of the invention.

The flashing may comprise, for example a substantially Z shaped strip 71, with one arm of the Z being adapted to be passed between the side 11 of the upright member 2 and side arm 72 of the lower channel member 5. A stem 73 of the Z shaped member 71 may rest upon part of the base of the U or J shaped member 70 and the other arm 74 of the substantially Z shaped member may extend down the outer walls of the building, as shown in FIG. 8. The arm 74 may be affixed to the wall, if desired, by for example, screws.

A further flashing 80 may be provided for the upper edge of an exterior wall, the further flashing 80 including a substantially vertical part 81 having a part 82 adapted to engage the outer cladding of the wall, by, for example turning the flashing 80 through, for example, about 30°. The upper end of the flashing 80 may be shaped to a substantially rectangular question mark shape, as shown in FIG. 9 at 83 and passed around a soffit lining 84 to retain the flashing in position.

A skirting member 90 may comprise a substantially vertical plate 91 having a catch means 92 thereon which has a bulbous part 93 adapted to catch under the extremity of the base of the U or J shaped member 70. A base plate engaging member 94 may also be provided which is adapted to rest on the space of the J shaped member 70 to further hold the skirting to the base plate 20. Spacers 95 and 96 may also be provided to space the skirting from cladding 97 and base plate 20 respectively. A further spacing member 98 may also be provided to space the lower spacing member 96 from the floor of the building.

Figure 9:
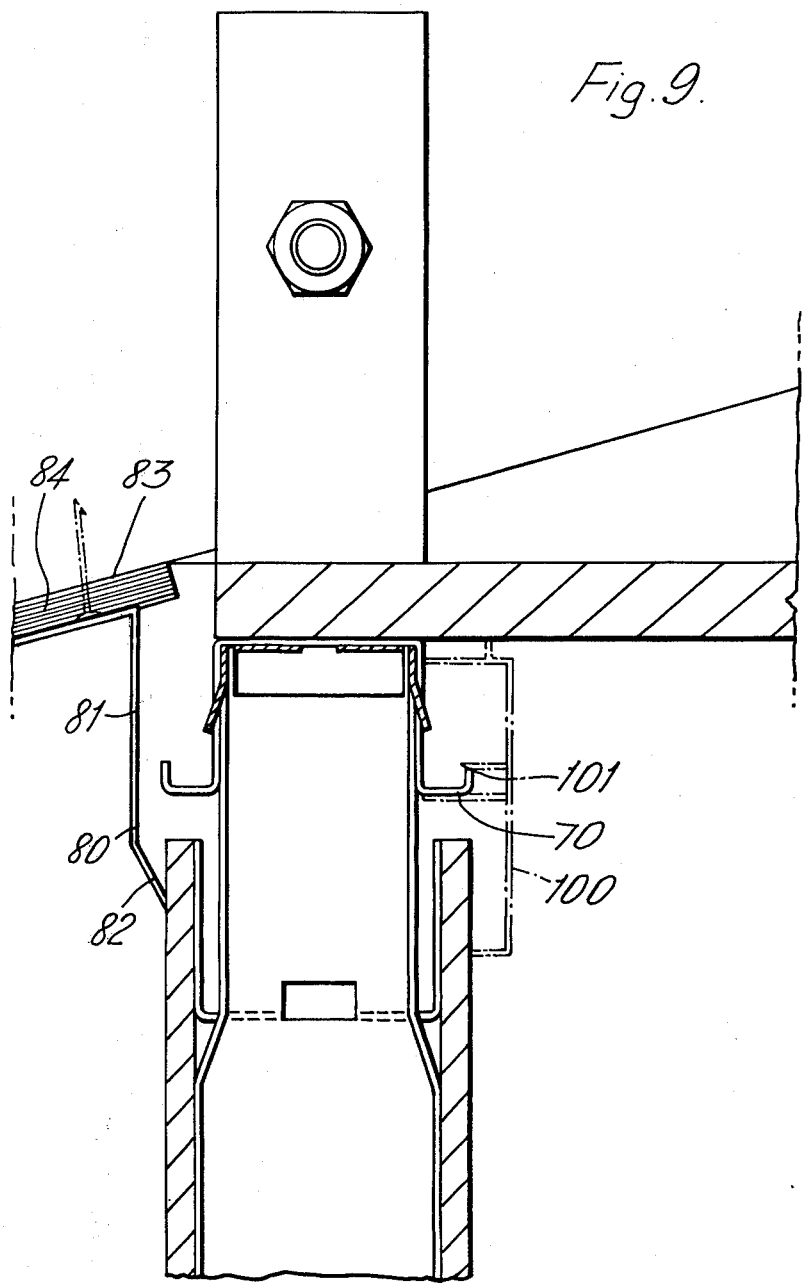
FIG. 9 is a cross-sectional view of the upper part of a wall panel fixed to a ceiling according to the invention.

The skirting member 90 may also be used as shown in FIG. 9 to form an architrave 100. With the architrave member 100, bulbous part 101 grips the extremity of the U or J shaped member 70 as before.

The architrave skirting and flashing may be constructed of any suitable material such as metal strip or PVC extrusion.

Figure 10:
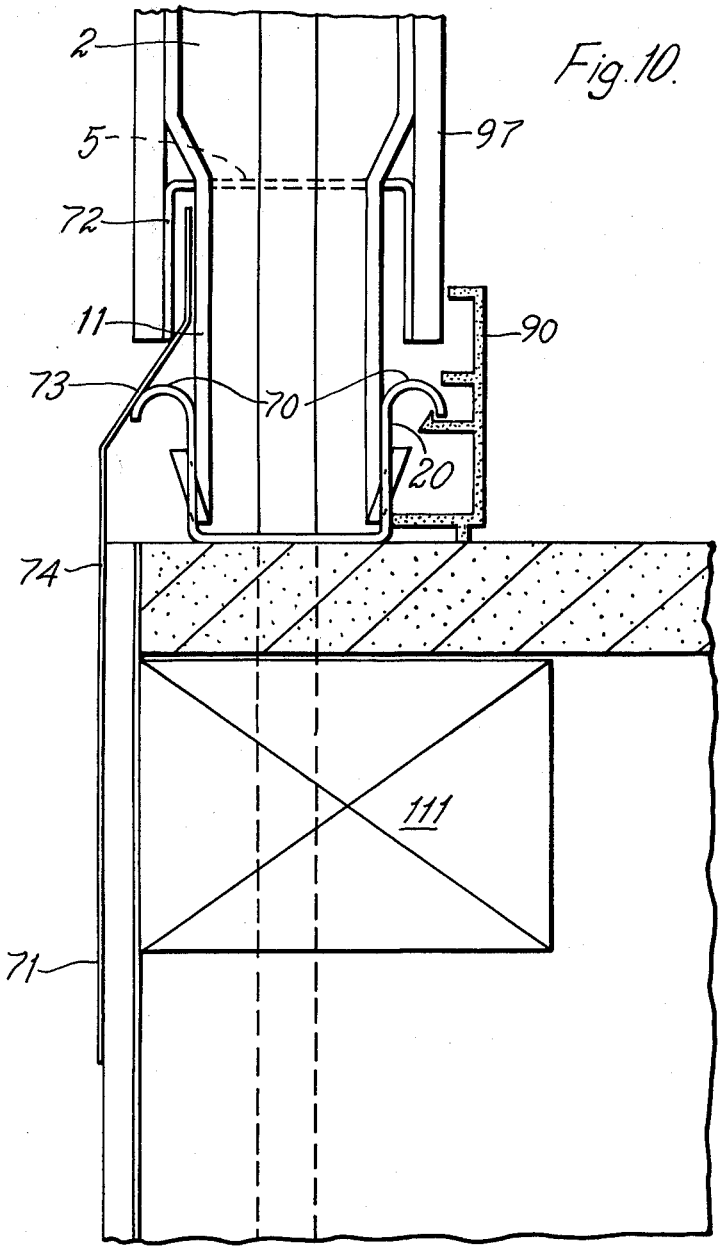
FIG. 10 is an alternative embodiment of FIG. 8

The wall system is transported as desired and because of the demountability, the wall system takes up very little space during transportation. On the site, foundations 110 or 111 as shown in FIGS. 8 and 10 respectively will have been prepared, or any other suitable foundations may have been prepared and the floor mounted on the foundation. In some circumstances, the foundations may comprise a concrete floor e.g. 110 or any other suitable construction, for example, concrete piles with floor joists and wooden flooring. The base plates 20 are mounted as desired on the floor being for example, bolted by bolts 112 (FIG. 8) bolted through suitable apertures in the base plate 20 or clipped or otherwise fixed and a panelling may then commence. A first panel is erected by placing the panel extensions 6 and 8 with the ears 10 on the extensions over the desired slots 23 in the base channel 20. The panel is then moved downwardly as a result of which the base channel 20 will be sprung outwardly against resistance thereto and when the ears 10 are completely engaged in the slots 23, the base 5 will close again through the resilient of the base channel 20 and the slot edges will engage the ears thus retaining the panel in position. In particular, the panels are located in the longitudinal direction of the wall.

The next panel is fitted in the same way, with jointing members being inserted between adjacent panels are fitted. The jointing strip comprises two h shaped members as previously described and the ends of the cladding members 50 and 57 fit in between the arms 34 and 35 or 36 and 37 of the h shaped members which are made of a flexible material such as a plastic material, and the result is that variations in positioning or size of the cladding end will not materially affect the positioning of other cladding ends in the joining strip. When the plug means is inserted, an extra rigidity is given to the erected panels and jointing strip.

The panels are positively located on the base member 20 and because the jointing system allows some latitude in panel spacing, accurate positioning of the panel relative to the base is assured, and little or no skilled labor is required on the site. In fact, the building could possibly be erected by "do-it-yourself" people.

Skirtings 90 are fixed in position, by for example, bringing the skirting so that the bulbous parts of the skirting fix into position behind the U or J shaped members 70 and on the outer face, flashings are provided which are fitted as shown in the drawings.

The lower member 5 is in the form of an inverted Pi or U section, the legs of the Pi consisting in two members, defining a slot therein, the open mouth of which extends to the head of the Pi member. Thus, this member may be formed by folding from sheet metal, with the legs being, for example, double folded and the inner sides of the double fold forming part of a channel member which is inverted in use.

Thus, the flashing member fits into position as shown in FIG. 8 and if desired a similar skirting member may be provided in place of the skirting member previously described.

The upper member 4 may be of a similar design if desired. Clearly, the cladding extends over the members defining the slots and a very simple construction is provided giving a neat finish at the lower edge of the panel whether or not the panel has a surface exposed exteriorally.

Cyclone rods 120 shown pecked in FIG. 10 may be provided if desired between the foundations or floor to the spaces between panels to be fixed to the rafters in any convenient way. The building may be completed by providing a ceiling or roof in any orthodox manner with the ceiling or roof rafters being fixed to the tapping member as above described to hold the top of the panels in position.

It is a particular advantage of the construction that an upper edge of the ear engages an upper edge of the slot in the base plate and a lower edge of the ear engages a lower edge of the slot in the capping member which ensures resistance to wind forces tending to lift the roof of the building.

Thus, the roof tied to these members will be resistant to uplift being passed from the roof to the base plate.

The construction results in one which can be easily erected on site, which is cheap to manufacture but which is very effective in use.

It is a particular advantage of the construction that because each panel is held in engagement with a base member and a capping member by means of the engagement of the ears in the slots, any secondary fixing of the panel to the base member or capping member by, for example, screws, bolts or adhesives is not required.

We claim:

1. A panel wall system including a plurality of panels, each panel comprising at least two spaced upright members having upper and lower ends and two spaced horizontal members interconnected to the upright members inwardly of the upper and lower ends of the upright members to provide upper and lower extensions for each upright member, each upright member having a base and parallel sides extending normal to the base, each horizontal member having a base and parallel sides extending normal to the base, said upright and horizontal members constituting a frame and cladding sheets fixed to the sides of the upright members and horizontal members inwardly of the horizontal members, a base plate having a base and parallel sides extending normal to the base, each side of the base plate being provided with axially spaced slots, the lower extension of each upright member having an ear cracked out of each side thereof adjacent the base whereby the ears lie in a plane substantially parallel to the plane of the base, the lower extensions of the upright members fitting between the sides of the base plate, the ears of each side of each lower extension being engaged in two adjacent slots in the sides of the base plate by expanding the sides of the base plate slightly during insertion, the sides of the base plate, after insertion, closing to engage suitable edges of the ears, an upper edge of the ears engaging an upper edge of the slots to resist uplift, a capping member having a base and spaced parallel sides, each side of the capping member being provided with axially spaced slots, the upper extension of each upright member having an ear cracked out of each side adjacent the base whereby the ears lie in a plane substantially parallel to the plane of the base, the upper extensions of the upright members fitted between the sides of the capping member, the ears of each side of each upper extension being engaged in two adjacent slots in the sides of the capping member by expanding the sides of the capping members slightly during insertion, the sides of the capping member, after insertion, closing to engage suitable edges of the ears, a lower edge of the ears of the upper extensions engaging an upper edge of the slots of the capping member to resist uplift, each side of the base plate and capping member, at its free end, being turned to provide a substantially U-shaped member, and flashing provided in operative arrangement with one of the U-shaped members of each of the base plate and capping member.

2. The panel wall system of claim 1, which further includes a skirting member which comprises a vertical plate; a catch means attached normal to said plate for catching said skirting member to said free edge of said U-shaped member; and spacing means attached to said plate parallel to said catch means to space said plate evenly from said cladding sheets when said panels are in place in said base plate.

3. The panel wall system of claim 2, wherein said skirting member is made from metal strip.

4. The panel wall system of claim 2, wherein said skirting member is made from extruded polyvinylchloride.

* * * * *